US007758366B2

(12) United States Patent
Masuda et al.

(10) Patent No.: US 7,758,366 B2
(45) Date of Patent: Jul. 20, 2010

(54) CONNECTOR FOR ELECTRICAL CONNECTION

(75) Inventors: Yasushi Masuda, Shinagawa (JP); Takeshi Okuyama, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/481,643

(22) Filed: Jun. 10, 2009

(65) Prior Publication Data

US 2009/0318036 A1 Dec. 24, 2009

(30) Foreign Application Priority Data

Jun. 23, 2008 (JP) ..... 2008-163828

(51) Int. Cl.
*H01R 13/64* (2006.01)

(52) U.S. Cl. ..... 439/247; 439/74; 439/660; 439/83

(58) Field of Classification Search ..... 439/660, 439/74, 83, 247, 248
See application file for complete search history.

(56) References Cited

U.S. PATENT DOCUMENTS 7,637,762 B2 * 12/2009 Uesaka ..... 439/247
2007/0202729 A1 8/2007 Uesaka

FOREIGN PATENT DOCUMENTS

JP 2007-149477 A 6/2007

* cited by examiner

*Primary Examiner*—Javaid Nasri
(74) *Attorney, Agent, or Firm*—IPUSA, PLLC

(57) ABSTRACT

In a connector, a fixed member is configured to be fixed to a substrate. An insertion member is arranged separate from the fixed member and configured to be insertable into an insertion part of a mating connector. Pairs of contacts are arranged on side surfaces of the insertion part of the mating connector to connect the fixed member and the insertion member to each other. Each contact includes a first fixed part fixed to the fixed member, a second fixed part fixed to the insertion member, and a contact part to contact with a contact piece of the mating connector. A cross-sectional shape of a portion of each contact between the first fixed part and the second fixed part is such that the insertion member is displaceable relative to the fixed member in an arranging direction of the pair of contacts and a direction perpendicular to the arranging direction.

11 Claims, 15 Drawing Sheets

CONNECTOR FOR ELECTRICAL CONNECTION

CROSS-REFERENCE TO RELATED APPLICATIONS

This application is based upon and claims the benefit of priority of the prior Japanese Patent Application No. 2008-163828, filed on Jun. 23, 2008, the entire contents of which are incorporated herein by reference.

FIELD

The embodiment discussed herein is directed to a connector for electrical connection.

BACKGROUND

Conventionally, there is a connector including: a fixed member fixed to a substrate; an insertion member arranged separate from the fixed member and configured to be inserted into an insertion part of a mating connector, such as zero insertion force socket (ZIF) connector, to which the connector is connected; and a pair of contacts that are electrically connected to the substrate and connect the fixed member and the insertion member.

The pair of contacts include a first contact and a second contact. The first contact is arranged on a first side surface of the insertion member. The second contact is arranged on a second side surface of the insertion member opposite to the first side surface. A plurality of first contacts and a plurality of second contacts are arranged on the first side surface and the second side surface, respectively.

Each of the first and second contacts arranged on the insertion member includes a contact part, which is brought into contact with a contact piece provided in the insertion part of the mating connector. The cross-sectional shape of each of the first and second contacts is set to be substantially the same in an extending direction of the first and second contacts. Specifically, the cross-sectional shape of each of the first and second contacts is set to be a rectangular shape having a width in an arranging direction of the pair of contacts larger than a width in a direction perpendicular to the arranging direction.

According to the conventional connector having the above-mentioned structure, it is possible to displace the insertion member relative to the fixed member in the direction perpendicular to the arranging direction of the pair of contacts (in a direction perpendicular to the first side surface) by connecting the fixed member to the insertion member of another connector via a plurality of pairs of contacts.

Thereby, even if there is a positional offset between the insertion member of the connector and the insertion part of the other connector in the direction perpendicular to the arranging direction of the pair of contacts, the insertion member can be surely inserted into the insertion part (for example, refer to Patent Document 1)

Patent Document 1: Japanese Lai-Open Patent Application No. 2007-149477

However, there may be a problem in the conventional connector in that the insertion member cannot be inserted into the insertion part, that is, the connector and the mating connector cannot be connected electrically, if the insertion part of the mating connector is displaced with respect to the insertion member of the connector in the arranging direction of the pair of contacts because the insertion member can be displaced only in the direction perpendicular to the arranging direction of the pair of contacts.

SUMMARY

It is a general object of the present invention to provide a connector in which the above-mentioned problem is eliminated.

A more specific objet of the present invention is to provide a connector having an insertion member configured to be surely insertable into an insertion part of a mating connector.

According to one aspect of the invention, a connector includes: a fixed member configured to be fixed to a substrate; an insertion member arranged separate from the fixed member and configured to be insertable into an insertion part of a mating connector; and a plurality of pairs of contacts arranged on side surfaces of the insertion part of the mating connector, the pairs of contacts connecting the fixed member and the insertion member to each other, wherein each contact of each pair of contacts includes a first fixed part fixed to the fixed member, a second fixed part fixed to the insertion member, and a contact part arranged on a side surface of the insertion member and configured to be brought into contact with a contact piece provided in the insertion part of the mating connector, and wherein a cross-sectional shape of a portion of each contact between the first fixed part and the second fixed part is configured in a shape such that the insertion member is displaceable relative to the fixed member in an arranging direction of the pair of contacts and a direction perpendicular to the arranging direction.

The object and advantages of the embodiment will be realized and attained by means of the elements and combinations particularly pointed out in the appended claims.

It is to be understood that both the foregoing general description and the following detailed description are exemplary explanatory only and are not restrictive of the invention, as claimed.

DESCRIPTION OF EMBODIMENTS

Preferred embodiments of the present invention will be explained with reference to the accompanying drawings.

First Embodiment

Figure 1:
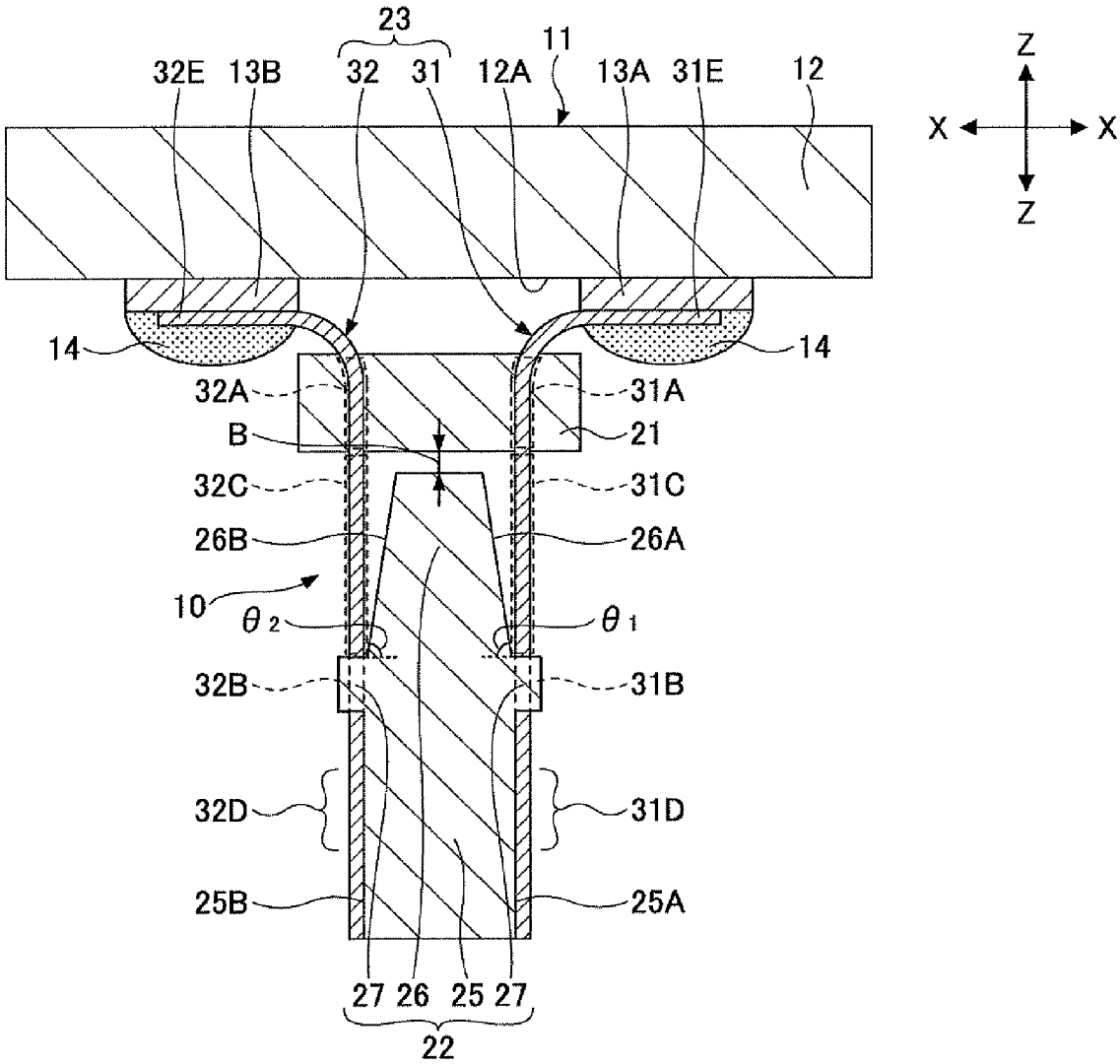
FIG. 1 is a cross-sectional view of a connector according to a first embodiment of the present invention.
Figure 2:
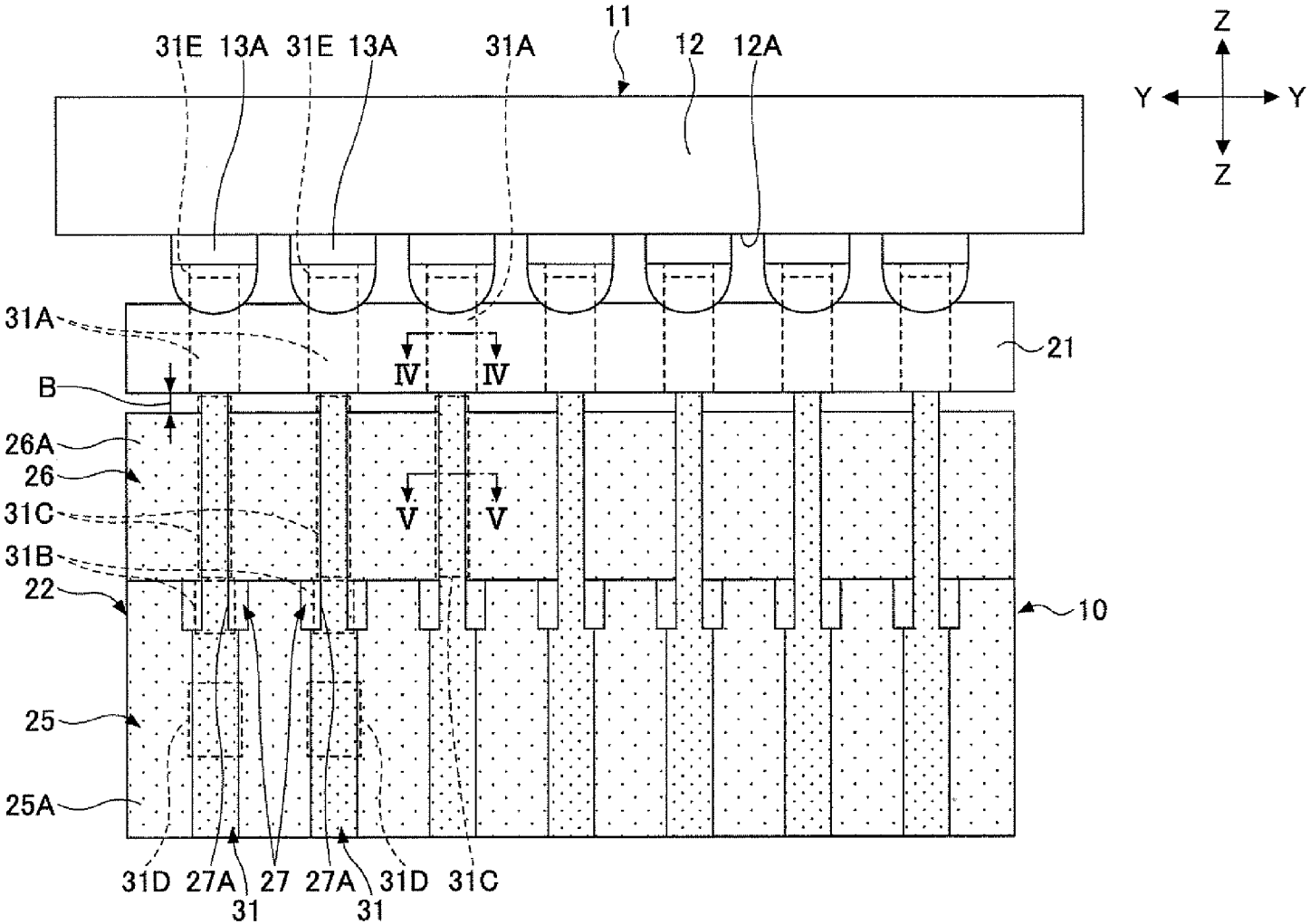
FIG. 2 is a side view of the connector illustrated in FIG. 1.
Figure 3:
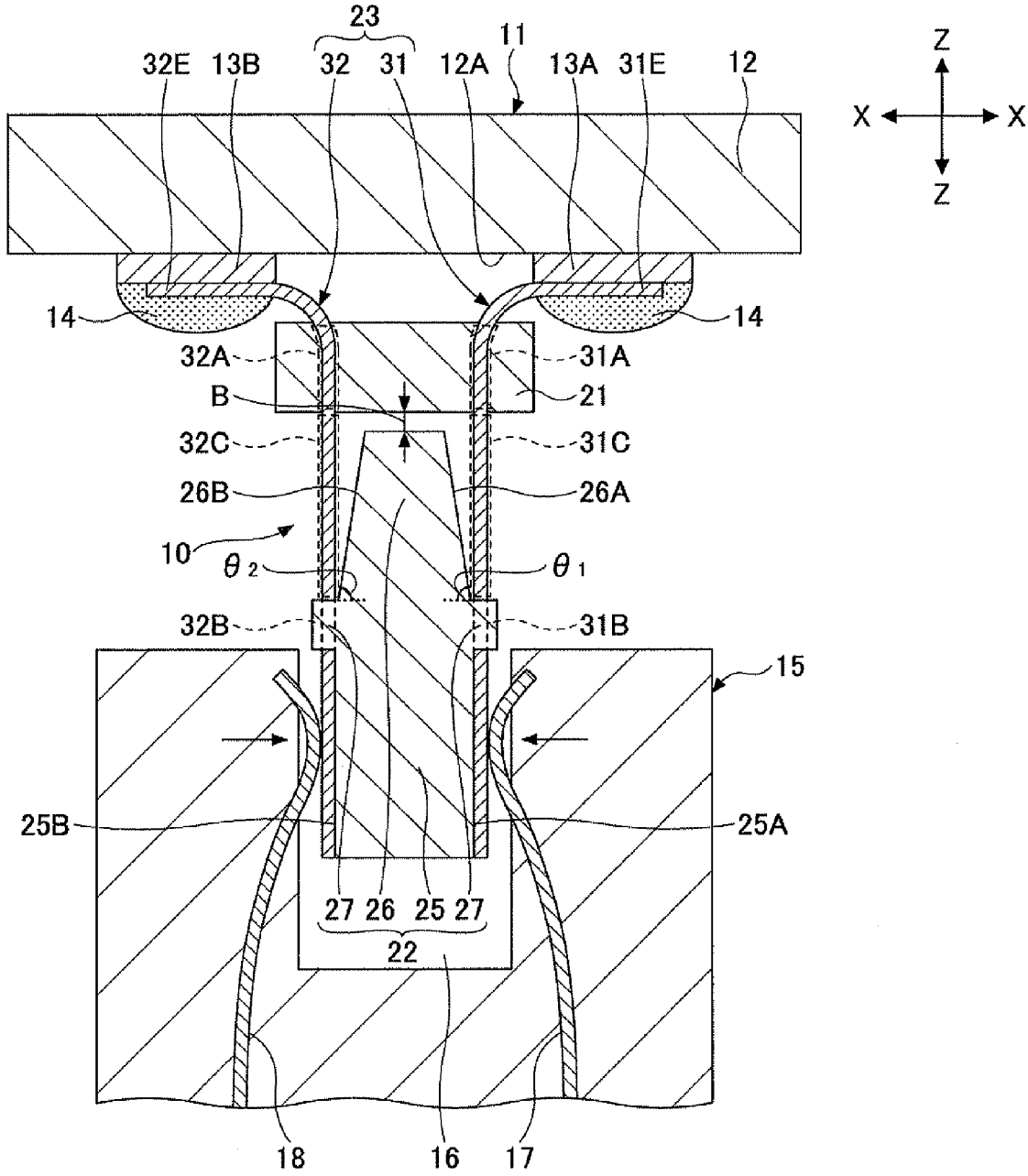
FIG. 3 is a cross-sectional view of the connector and a mating connector in a state where the connector is attached to the mating connector.

FIG. 1 is a cross-sectional view of a connector according to a first embodiment of the present invention. FIG. 2 is a side view of the connector illustrated in FIG. 1. FIG. 3 is a cross-sectional view of the connector and a mating connector in a state where the connector is attached to the mating connector. In FIGS. 1 and 3, the X-X direction is perpendicular to the Y-Y direction indicated in FIG. 2 in the same plane. The Y-Y direction corresponds to an arranging direction A of a pair of contacts 23. The Z-Z direction indicated in FIGS. 1 through 3 is perpendicular to the plane defined by the X-X direction and the Y-Y direction.

Referring to FIG. 1 through FIG. 3, the connector 10 according to the first embodiment includes a fixed member 21, an insertion member 22 and a contact pair 23, which is a pair of contacts 31 and 32. The connector 10 is electrically connected to a mating connector 15 such as, for example, a zero insertion force socket (ZIF) connector. Specifically, the insertion part 22 of the connector 10 is inserted into an insertion part of 16 of the mating connector 15, and the contacts 31 and 32 of the contact pair 23 are brought into contact with a pair of contact pieces 17 and 18, respectively (refer to FIG. 3).

The fixed member 21 is a member having an insulating characteristic, and is arranged between a substrate 11 and the insertion member 22 in a state separated from the substrate 11 and the insertion member 22. The fixed member 21 is a member for sealing a portion of the pair of contacts 23. Specifically, the fixed member 21 supports first fixed parts 31A and 32A of the contacts 31 and 32, which constitute the contact pair 23. The fixed member 21 is attached to the substrate 11 via the contact pair 23.

A description will be given below of the substrate 11 to which the connector 10 is mounted. The substrate 11 includes a substrate main part 12 and pads 13A and 13B. The substrate main part 12 includes an insulating layer (not shown in the figure), vias, wirings, etc. The pads 13A and 13B are provided on a bottom surface 12A of the substrate main part 12. The pads 13A and 13B are electrically connected to the vias and the wirings provided in the substrate main part 12. The pads 13A and 13B are provided for surface-mounting the contacts 31 and 32, respectively. The substrate 11 of the above-mentioned structure corresponds to, for example, a probe card.

The insertion member 22 is a member having an insulating characteristic and is separated from the fixed member 21. The insertion member 22 is arranged under the fixed member 21 in a state where the insertion member 22 is separated from the fixed member 21. The insertion member 22 is connected to the fixed member 21 through a plurality of the contact pairs 23. The insertion member 22 includes an insertion member main part 25, a projection part 26, and a contact attaching part 27

The insertion member main part 25 is configured to be inserted into the insertion part 16 of the mating connector 15. The insertion member main part 25 is integrally formed with the projection part 26 and the contact attaching part 27. The insertion member main body 25 has side surfaces 25A and 25B on which the respective one of contacts 23 are arranged.

The projection part 26, which is a part of the insertion member 22 between the fixed member 21 and second fixed parts 31B and 32B mentioned later, is provided to the insertion member main body 25 located on a side opposite to the fixed member 21. The projection part 26 is integrally formed with the insertion member main body 25, and protrudes from the upper end of the insertion member main body 25 in a direction (Z-Z direction) toward the fixed member 21. A gap B is formed between the projection part 26 and the fixed member 21. The distance of the gap B is set to about 0.5 mm.

Because the gap B of about 0.5 mm is formed between the projection part 26 and the fixed member 21, the fixed member 21 and the projection member 26 are prevented from being brought into contact with each other even if the insertion member is displaced in the X-X direction or the Y-Y direction.

The projection part 26 is formed in a shape in which the width in a direction (X-X direction) perpendicular to the arranging direction A of the contact pair 23 decreases from the second fixed parts 31B and 32B toward the fixed member 21, that is, from the insertion member main body 25 toward the fixed member 21. The projection part 26 has a slanting surface 26A facing the contact 31 and a slanting surface 26B facing the contact 32. The angle θ1 of the slanting surface 26A is set to an angle in a range of 60 degrees to 70 degrees. In this case, the angle θ2 of the slanting surface 26B is also set to an angle in a range of 60 degrees to 70 degrees.

Thus, because the width of the protrusion part 26 is reduced in the direction (X-X direction) perpendicular to the arranging direction of the contact pair 23 from the insertion member main body 25 toward the fixed member 21, there is a space provided in which the contacts 31 and 32 are movable in the X-X direction. Moreover, an amount of movement of the contacts 31 and 32 in the X-X direction can be controlled by the protrusion part of the portions corresponding to the slanting surfaces 26A and 26B.

A plurality of contact attaching parts 27 are provided to each of the side surfaces 25A and 25B of the insertion member main body 25. Each of the contact attaching parts 27 has an opening part 27A to which the second fixed parts 31B and 32B of the contacts 31 and 32 are attached. The contact attaching part 27 is provided for fixing the contacts 31 and 32 to the insertion member 22 by attaching the second fixed parts 31B and 32B of the contacts 31 and 32 to the opening part 27.

A plurality of contact pairs 23 are arranged on the side surfaces 25A and 253 of the insertion member main body 25. Each of the contact pairs 23 includes the contact 31 and the contact 32. The contact pair 23 movably supports the insertion member 22 relative to the fixed member 21 by connecting the fixed member 21 and the insertion member 22 to each other, which are arranged separately from each other.

Referring to FIG. 1 through FIG. 3, the contact 31 is L-shaped and is provided on the side surface 25A of the insertion member main body 25. A plurality of contacts 31 are arranged in the Y-Y direction. Each of the contacts 31 includes a first fixed part 31A, a second fixed part 31B, a deformable part 31C, a contact part 31D, and a connection part 31E, which are integrally formed with each other.

The first fixed part 31A is embedded in the fixed member 21 in a state where the first fixed part 31A penetrates the fixed member 21. Thereby, the contact 31 is fixed to the fixed member 21.

Figure 4:
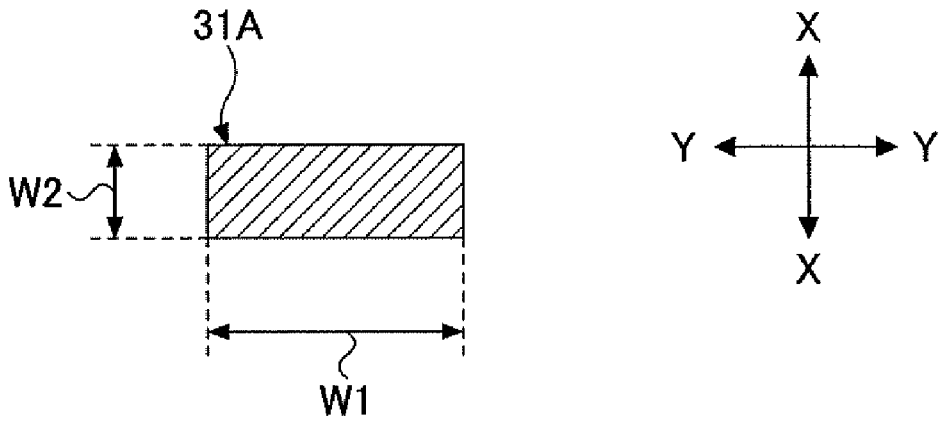
FIG. 4 is a cross-sectional view of a first fixed part provided in a contact illustrated in FIG. 2 taken along a line IV-IV.

FIG. 4 is a cross-sectional view of the first fixed part provided in the contact illustrated in FIG. 2 taken along a line IV-IV. As illustrated in FIG. 4, the cross-sectional shape of the first fixed part 31A is a rectangular shape having a width W1 in the Y-Y direction larger than a width W2 in the X-X direction. The Y-Y direction corresponds to the arranging direction A of the contacts 31 and 32 of the contact pair 23. The width W1 of the first fixed part 31A can be set to, for example, 0.2 mm. In this case, the width W2 of the first fixed part 31A can be set to, for example, 0.15 mm.

Referring to FIG. 1 through FIG. 3, the second fixed part 31B is attached to the opening part 27A of the contact attaching part 27 formed on the side surface 25A of the insertion member main body 25. Thereby, the contact 31 is fixed to the insertion member 22.

As mentioned above, the fixed member 21 and the insertion member 22 are connected to each other by fixing the first fixed part 31A to the fixed member 21 and also attaching the second fixed part 31B to the contact attaching part 27. The cross-sectional shape and dimensions (widths) of the second fixed part 31B may be substantially the same as the cross-sectional shape and dimensions (widths) of the first fixed part 31A mentioned before.

The deformable part 31C is provided between the first fixed part 31A and the second fixed part 31B. The deformable part 31C extends in the Z-Z direction in order to connect the first fixed part 31A to the second fixed part 31B. The deformable part 31C is configured and arranged so that the insertion member 22 is displaceable with respect to the fixed member 21 in the Y-Y direction (the arranging direction A of the contacts 31 and 32 of the contact pair 23) and the X-X direction.

Figure 5:
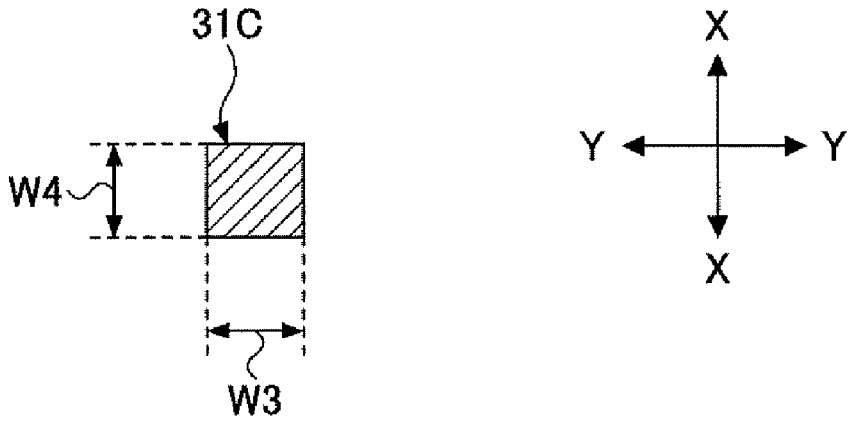
FIG. 5 is a cross-sectional view of a deformable part provided in the contact illustrated in FIG. 2 taken along a line V-V.

FIG. 5 is a cross-sectional view of the deformable part provided in the contact illustrated in FIG. 2 taken along a line V-V. As illustrated in FIG. 5, the cross-sectional shape of the deformable part 31C is formed in a shape in which a width W3 in the Y-Y direction is substantially equal to a width W4 in the X-X direction. The cross-sectional shape of the deformable part 31C is set to, for example, a square shape. The widths W3 and W4 can be set to, for example, 0.15 mm.

A rigidity of the deformable part 31C in the X-X direction is substantially the same as a rigidity of the deformable part 31C in the Y-Y direction because the width W3 in the X-X direction is equal to the width W4 in the Y-Y direction. Thus, when an external force is exerted on the insertion member 22, the deformable part 31C can be deformed in the X-X direction and the Y-Y direction.

Referring to FIG. 1 through FIG. 3, the contact part 31D is arranged on the side surface 25A of the insertion member main body 25 in a state where the contact 31 is attached to the contact attaching part 27. The contact part 31D is a part to be brought into contact with the contact piece 17 provided in the insertion part 16 of the mating connector 15. The cross-sectional shape and dimensions (widths) of the contact part 31D are substantially the same as the cross-sectional shape and dimensions (widths) of the first fixed part 31A mentioned before.

The connection part 31E is a part to electrically connect the contact 31 to the substrate 11. The connection part 31E is fixed to the pad 13A provided in the bottom surface 12A of the substrate main part 12 with a solder 14. Thereby, the connection part 31E is fixed to the substrate 11 while being electrically connected to the substrate 11. The cross-sectional shape and dimensions (widths) of the connection part 31E can be substantially the same as the cross-sectional shape and dimensions (widths) of the first fixed part 31A mentioned before.

The contact 31 is formed, for example, by bending a plate material. As for the material of the contact 31, for example, a material excellent in strength, electrical conductivity and bending workability can be used. Specifically, a material such as, for example, a Cu—Ni—Si base (Corson series) alloy, a hyper phosphor bronze, a titanium copper, etc., may be used.

Referring to FIG. 1 through FIG. 3, the contact 32 is L-shaped and is provided on the side surface 25B of the insertion member main body 25. A plurality of contacts 32 are arranged in the Y-Y direction. Each of the contacts 32 includes a first fixed part 32A, a second fixed part 32B, a deformable part 32C, a contact part 32D, and a connection part 32E, which are integrally formed with each other.

The first fixed part 32A is embedded in the fixed member 21 in a state where the first fixed part 32A penetrates the fixed member 21. Thereby, the contact 32 is fixed to the fixed member 21.

Similar to the first fixed part 31A mentioned above, the cross-sectional shape of the first fixed part 32A is a rectangular shape having a width in the Y-Y direction larger than a width in the X-X direction. The Y-Y direction corresponds to the arranging direction A of the contacts 31 and 32 of the contact pair 23. The width of the first fixed part 32A in the Y-Y direction can be set to, for example, 0.2 mm. In this case, the width of the first fixed part 32A in the X-X direction can be set to, for example, 0.15 mm.

The second fixed part 32B is attached to the opening part 27A of the contact attaching part 27 formed on the side surface 25B of the insertion member main body 25. Thereby, the contact 32 is fixed to the insertion member 22.

As mentioned above, the fixed member 21 and the insertion member 22 are connected to each other by fixing the first fixed part 32A to the fixed member 21 and also attaching the second fixed part 32B to the contact attaching part 27. The cross-sectional shape and dimensions (widths) of the second fixed part 32B may be substantially the same as the cross-sectional shape and dimensions (widths) of the first fixed part 32A mentioned before.

The deformable part 32C is provided between the first fixed part 32A and the second fixed part 32B. The deformable part 32C extends in the Z-Z direction in order to connect the first fixed part 32A to the second fixed part 32B. The deformable part 32C is configured and arranged so that the insertion member 22 is displaceable with respect to the fixed member 21 in the Y-Y direction (the arranging direction A of the contacts 31 and 32 of the contact pair 23) and the X-X direction.

Similar to the deformable part 31C mentioned above, the cross-sectional shape of the deformable part 32C is formed in a shape in which a width in the Y-Y direction is substantially equal to a width in the X-X direction. The cross-sectional shape of the deformable part 32C is set to, for example, a square shape. The width of the deformable part 32C in the X-X direction and the width of the deformable part 32C in the Y-Y direction can be set to, for example, 0.15 mm.

A rigidity of the deformable part 32C in the X-X direction is substantially the same as a rigidity of the deformable part 32C in the Y-Y direction because the width in the X-X direction is equal to the width in the Y-Y direction. Thus, when an external force is exerted on the insertion member 22, the deformable part 32C can be deformed in the X-X direction and the Y-Y direction.

The contact part 32D is arranged on the side surface 25B of the insertion member main body 25 in a state where the contact 32 is attached to the contact attaching part 27. The contact part 32D is a part to be brought into contact with the contact piece 18 provided in the insertion part 16 of the mating connector 15. The cross-sectional shape and dimensions (widths) of the contact part 31D are substantially the same as the cross-sectional shape and dimensions (widths) of the first fixed part 32A mentioned before.

The connection part 32E is a part to electrically connect the contact 32 to the substrate 11. The connection part 32E is fixed to the pad 13B provided in the bottom surface 12A of the substrate main part 12 with a solder 14. Thereby, the connection part 32E is fixed to the substrate 11 while being electrically connected to the substrate 11. The cross-sectional shape and dimensions (widths) of the connection part 32E can be substantially the same as the cross-sectional shape and dimensions (widths) of the first fixed part 32A mentioned before.

The contact 32 is formed, for example, by bending a plate material. As for the material of the contact 32, for example, a material excellent in strength, electrical conductivity and bending workability can be used. Specifically, a material such as, for example, a Cu—Ni—Si base (Corson series) alloy, a hyper phosphor bronze, a titanium copper, etc., may be used.

In the connector 10 of the above-mentioned structure, the fixed member 21 and the insertion member 22 are connected by the plurality of contacts 31 and 32 (the contact pair 23) and the widths of the deformable parts 31C and 32C in the arranging direction (Y-Y direction) of the contacts 31 and 32 of the contact pair 23 and the width of the deformable parts 31C and 32C in the direction (Y-Y direction) perpendicular to the arranging direction (X-X direction) of the contacts 31 and 32 of the contact pair 23 are substantially equal to each other. Thereby, the rigidity of the deformable parts 31C and 32C in the X-X direction and the rigidity of the deformable parts 31C and 32C in the Y-Y direction are substantially equal to each other, which permits deformation of the deformable parts 31C and 32C in the X-X direction and the Y-Y direction when an external force is exerted on the insertion member 22.

Figure 6:
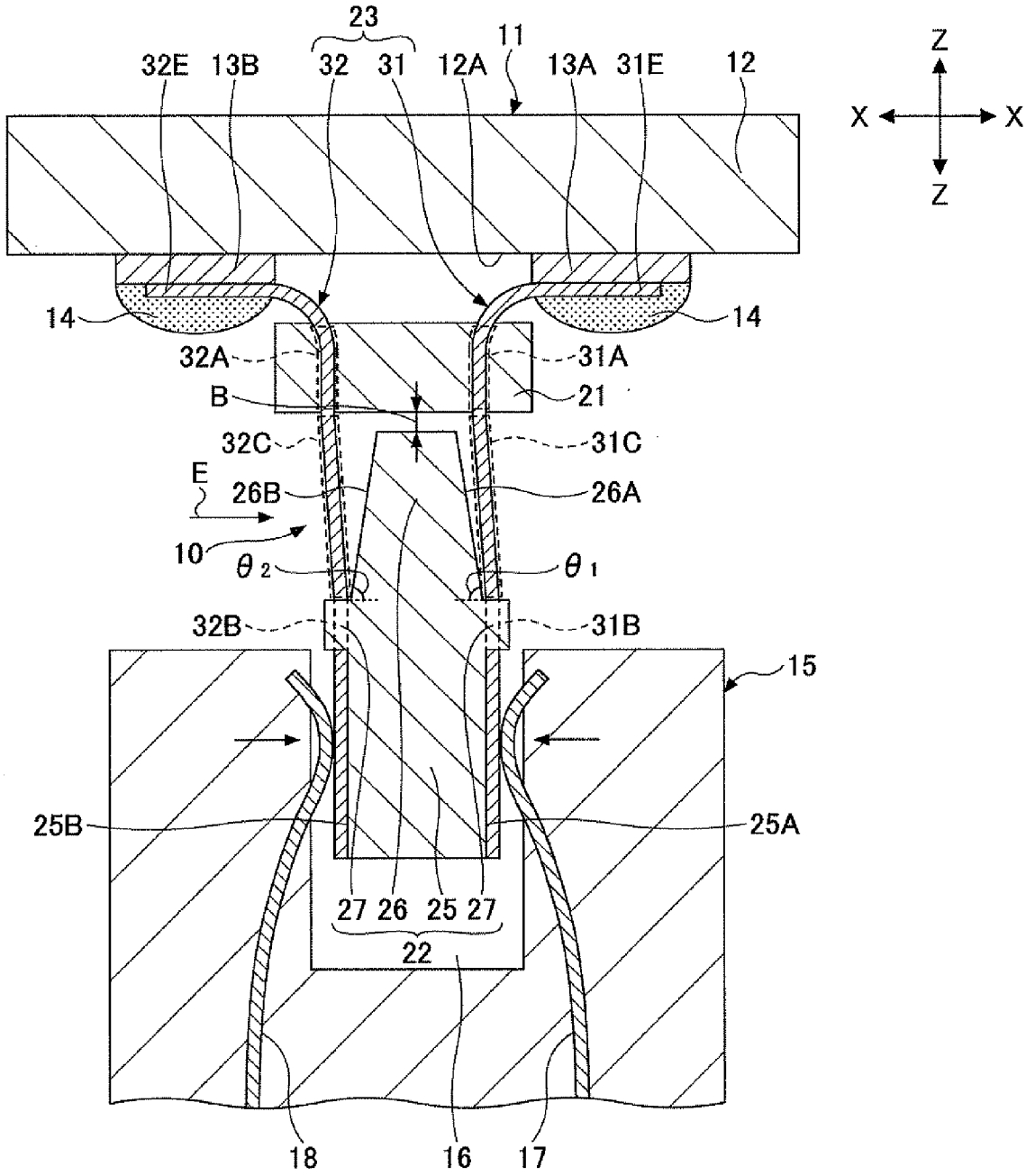
FIG. 6 is a cross-sectional view of the connector and the mating connector in a state where an insertion member is displaced with respect to an insertion part of the mating connector.
Figure 7:
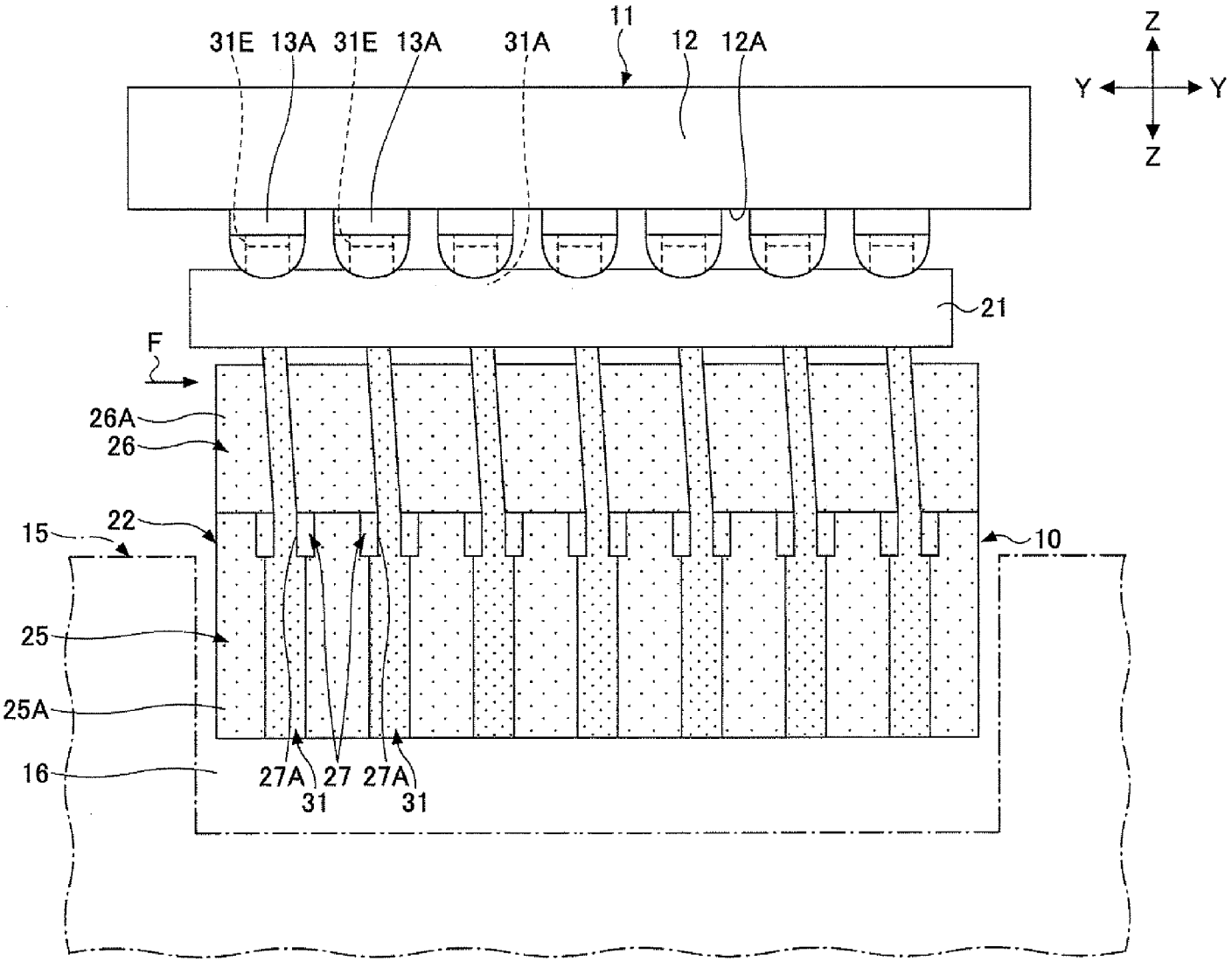
FIG. 7 is a side view of the connector and the mating connector in the state where the insertion member is displaced with respect to the insertion part of the mating connector.

FIG. 6 is a cross-sectional view of the connector 10 and the mating connector 15 in a state where the insertion member is displaced with respect to the insertion part of the mating connector in the X-X direction and the Y-Y direction. FIG. 7 is a side view of the connector 10 and the mating connector 15 in a state where the insertion member is displaced with respect to the insertion part of the mating connector in the X-X direction and the Y-Y direction. In FIGS. 6 and 7, parts that are the same as the parts illustrated in FIG. 3 are given the same references. In FIG. 6, an arrow E indicates a direction of displacement in the X-X direction. The direction indicated by the arrow W is referred to as a direction E. In FIG. 7, an arrow F indicates a direction of displacement in the Y-Y direction. The direction indicated by the arrow F is referred to as a direction F.

For example, as illustrated in FIGS. 6 and 7, even when the insertion member 22 of the connector 10 is displaced with respect to the insertion part 16 of the mating connector 15 in the X-X direction and the Y-Y direction, the insertion member 22 of the connector 10 can be surely inserted into the insertion part 16 of the mating connector 15 by moving the insertion member 22 in the direction E and the direction F by causing the deformable parts 31C and 32C to deform in the X-X direction and the Y-Y direction.

It should be noted that if the insertion member 22 is displaced with respect to the insertion part 16 of the mating connector 15 in only one of the X-X direction and the Y-Y direction, the insertion member 22 of the connector 10 can be surely inserted into the insertion part 16 of the mating connector 15 by moving the insertion member 22 in the one of the X-X direction and the Y-Y direction.

As mentioned above, in the connector 10 according to the present embodiment, because the fixed member 21 and the insertion member 22 are connected to each other by the plurality of contacts 31 and 32 (the contact pair 23) and the cross-sectional shapes of the contacts 31 and 32 are configured so that the widths of the deformable parts 31C and 32C in the arranging direction (Y-Y direction) of the contacts 31 and 32 of the contact pair 23 and the width of the deformable parts 31C and 32C in the direction (Y-Y direction) perpendicular to the arranging direction (X-X direction) of the contacts 31 and 32 of the contact pair 23 are substantially equal to each other, the rigidity of the deformable parts 31C and 32C in the X-X direction and the rigidity of the deformable parts 31C and 32C in the Y-Y direction are substantially equal to each other, which permits deformation of the deformable parts 31C and 32C in the X-X direction and/or the Y-Y direction when an external force is exerted on the insertion member 22. Thus, even when the insertion member 22 of the connector 10 is displaced with respect to the insertion part 16 of the mating connector 15 in the X-X direction and/or the Y-Y direction, the insertion member 22 of the connector 10 can be surely inserted into the insertion part 16 of the mating connector 15 by moving the insertion member 22 in the X-X direction and/or the Y-Y direction.

Although the cross-sectional shape of each of the deformable parts 31C and 32C is a square shape in the present embodiment, the cross-sectional shape of each of the deformable parts 31C and 32C is not limited to a square shape if it is a shape in which the widths of the deformable parts 31C and 32C in the arranging direction A of the contacts 31 and 32 of the contact pair 23 are substantially equal to the widths of the deformable parts 31C and 32C in the direction perpendicular to the arranging direction A. For example, the cross-sectional shape of each of the deformable parts 31C and 32C may be a circular shape.

If the cross-sectional shape of each of the deformable parts 31C and 32C is a circular shaper the rigidities of the deformable parts 31C and 32C in all directions in the plane defined by the X-X direction and the Y-Y direction are substantially equal to each other. Thereby, the insertion member 22 can be displaced in all directions in the plane defined by the X-X direction and the Y-Y direction.

Figure 8:
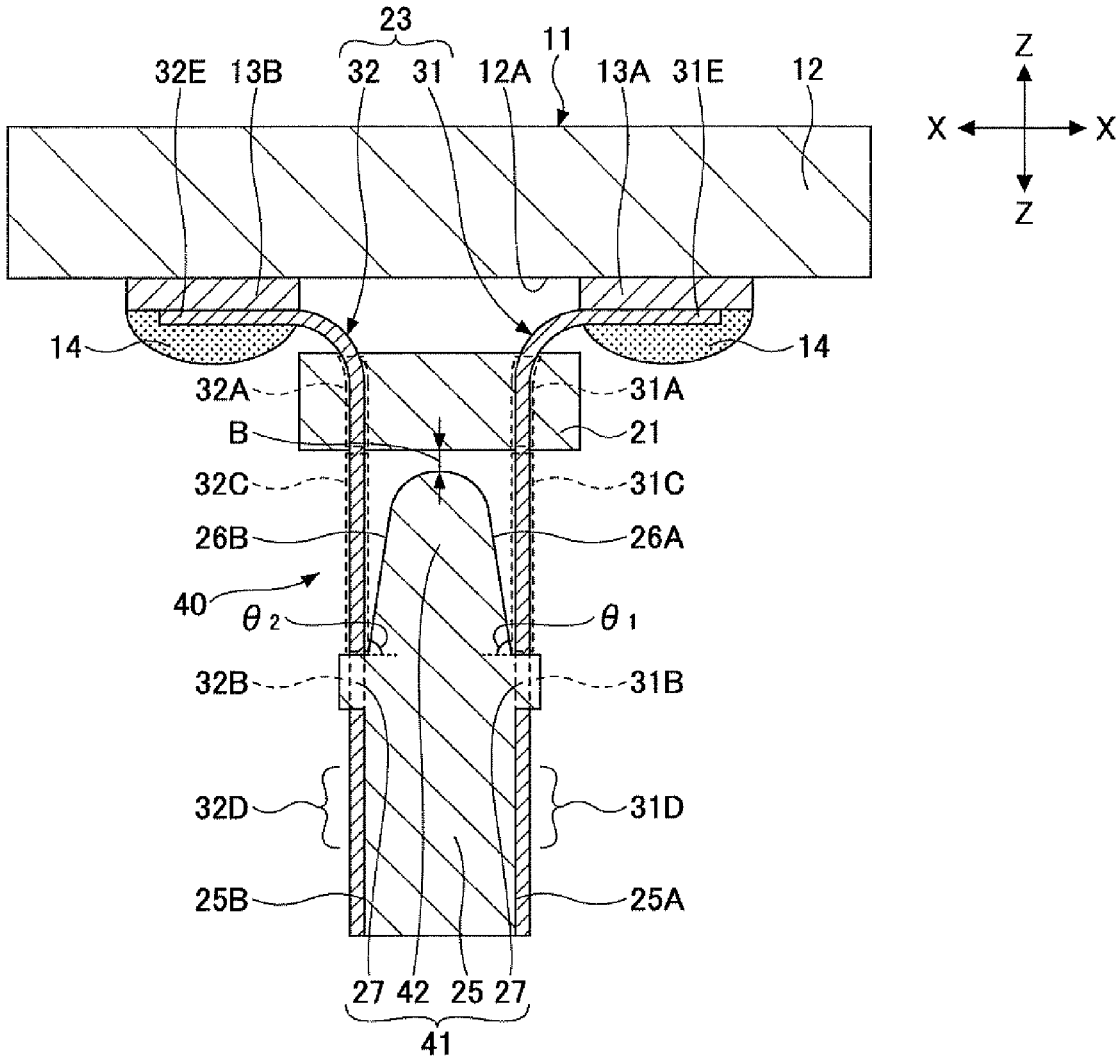
FIG. 8 is a cross-sectional view of a connector according to a first variation of the first embodiment.

FIG. 8 is a cross-sectional view of a connector according to a first variation of the first embodiment. In FIG. 8, parts that are the same as the parts of the connector 10 according to the first embodiment are given the same reference numerals.

As illustrated in FIG. 8, the connector 40 according to the first variation of the first embodiment has the same structure as the above mentioned connector 10 except that an insertion member 41 is provided instead of the insertion member 22 provided in the connector 10 of the first embodiment.

The insertion member 41 is separate from the fixed member 21, and has the same structure as the insertion member 22 except for a projection part 42 being provided instead of the projection part 26 of the insertion member 22.

The projection part 42 (the insertion member 41 arranged between the fixed member 21 and the fixed parts 31B and 32B) is provided on an end of the insertion member main body 25 on the side facing the fixed member 21, and is integrally formed with the insertion member main body 25. The projection part 42 protrudes from an upper end of the insertion member main body 25 in a direction (Z-Z direction) toward the fixed member 21. The projection part 42 has the same structure as the projection part 26 except the end of the projection part 42 facing the fixed member 21 has a rounded shape with no angled portion.

By forming the end of the projection part 42 facing the fixed member 21 in a rounded shape having no angled portion, the insertion member 41 can be prevented surely from being brought into contact with the fixed member 21 when the insertion member 22 is displaced due to deformation of the contact pair 23. Additionally, the contactor 40 according to the first variation can provide the same effects as the connector according to the first embodiment.

Figure 9:
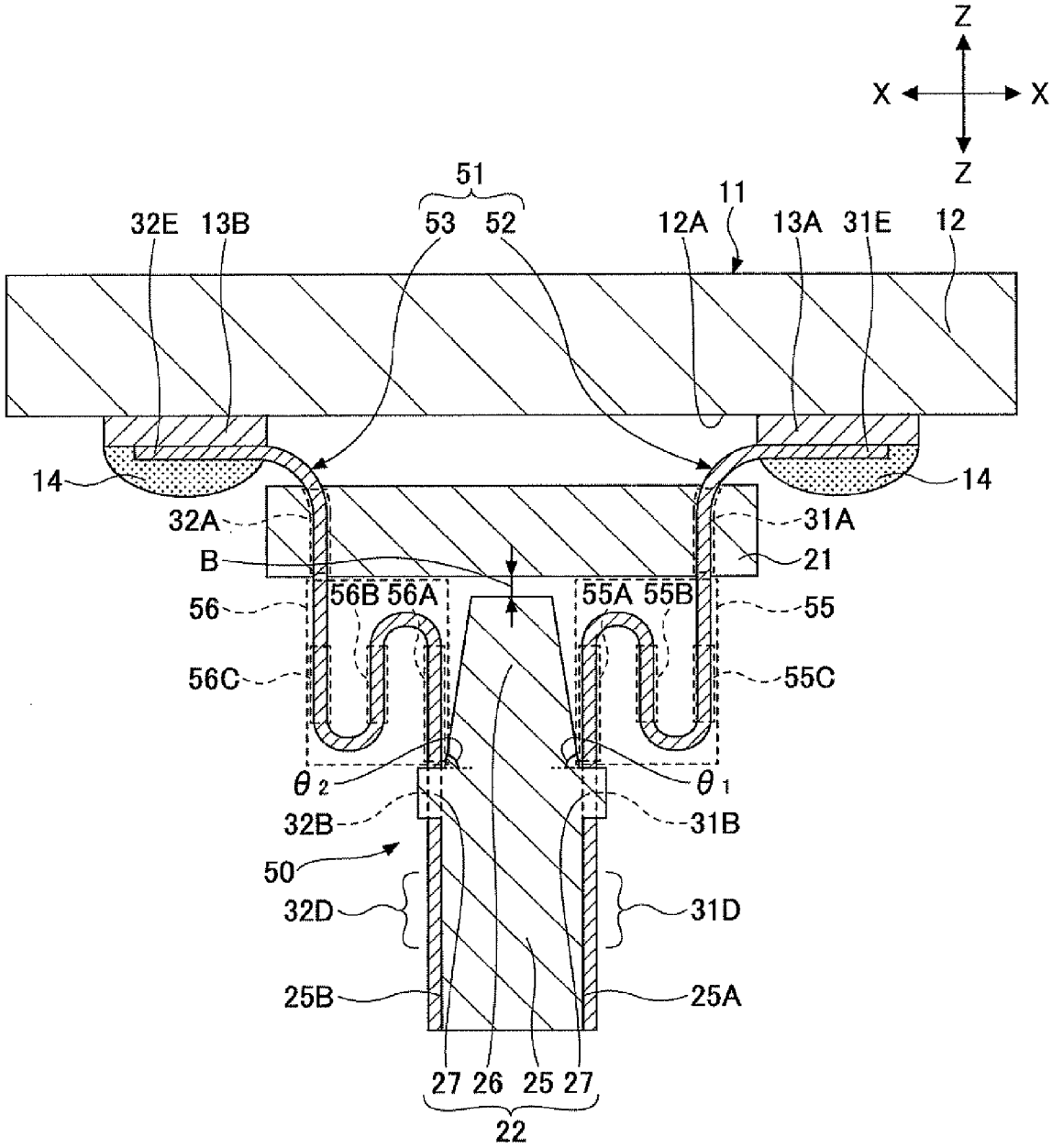
FIG. 9 is a cross-sectional view of a connector according to a second variation of the first embodiment.

FIG. 9 is a cross-sectional view of a connector according to a second variation of the first embodiment. In FIG. 9, parts that are the same as the parts of the connector 10 according to the first embodiment are given the same reference numerals.

As illustrated in FIG. 9, the connector 50 according to the second variation of the first embodiment has the same structure as the connector 10 according to the first embodiment except that a contact pair 51 is provided instead of the contact pair 23 of the connector 10 of the first embodiment. A plurality of contact pairs 51 are arranged on the side surfaces 25A and 25B of the insertion member main body 25. Each of the contact pairs 51 includes a contact 52 and a contact 53. The contact 52 is provided on the side surface 25A of the insertion member main body 25, and the contact 53 is provided on the side surface 25B of the insertion member main body 25.

The contact 52 has the same structure as the contact 31 of the contactor 10 according to the first embodiment except for a deformable part 55 being provided instead of the deformable part 31C provided in the contact 31.

The deformable part 55 is provided between the first fixed part 31A and the second fixed part 31B. The deformable part 55 connects the first fixed part 31A to the second fixed part 31B. The deformable part 55 is bent or folded twice in the Z-Z direction, and includes straight portions 55A through 55C, which extend in the Z-Z direction. The cross-sectional shape of at least one of the straight portions 55A through 55C of the contact 52 has a shape in which a width of the deformable part 55 in an arranging direction (Y-Y direction) of the contacts 52 and 53 of the contact pair 51 is substantially equal to a width of the deformable part 55 in a direction (X-X direction) perpendicular to the arranging direction of the contacts 52 and 53 of the contact pair 51.

Specifically, for example, the cross-sectional shape of the contact 52 can be a square shape. In such a case, the width of the deformable part 55 in the X-X direction can be, for example, 0.2 mm, and the width in the Y-Y direction can be 0.2 mm. Accordingly, a rigidity of the deformable part 55 in the X-X direction is substantially the same as a rigidity of the deformable part 55 in the Y-Y direction because the width in the X-X direction is equal to the width in the Y-Y direction. Thus, when an external force is exerted on the insertion member 22, the deformable part 55 can be deformed in the X-X direction and the Y-Y direction.

Similar to the contact 52, the contact 53 has the same structure as the contact 32 of the contactor 10 according to the first embodiment except for a deformable part 56 being provided instead of the deformable part 32C provided in the contact 32.

The deformable part 56 is provided between the first fixed part 32A and the second fixed part 32B. The deformable part 56 connects the first fixed part 32A to the second fixed part 32B. The deformable part 56 is bent twice in the Z-Z direction, and includes straight portions 56A through 56C, which extend in the Z-Z direction. The cross-sectional shape of at least one of the straight portions 5CA through 56C of the contact 53 has a shape in which a width of the deformable part 56 in the arranging direction (Y-Y direction) of the contacts 52 and 53 of the contact pair 51 is substantially equal to a width of the deformable part 56 in the direction (X-X direction) perpendicular to the arranging direction of the contacts 52 and 53 of the contact pair 51.

Specifically, for example, the cross-sectional shape of the contact 53 can be a square shape. In such a case, the width of the deformable part 56 in the X-X direction can be, for example, 0.2 mm, and the width in the Y-Y direction can be 0.2 mm. Accordingly, a rigidity of the deformable part 56 in the X-X direction is substantially the same as a rigidity of the deformable part 56 in the Y-Y direction because the width in the X-X direction is equal to the width in the Y-Y direction. Thus, when an external force is exerted on the insertion member 22, the deformable part 56 can be deformed in the X-X direction and the Y-Y direction.

The connector 50 according to the second variation having the above-mentioned structure can provide the same effects as the connector 10 of the first embodiment.

Although the cross-sectional shape of each of the deformable parts 55 and 56 is a square shape in the connector 50 according to the second variation, the cross-sectional shape of each of the deformable parts 55 and 56 is not limited to a square shape. For example, the cross-sectional shape of each of the deformable parts 55 and 56 may be a circular shape.

If the cross-sectional shape of each of the deformable parts 55 and 56 is a circular shape, the rigidities of the deformable parts 55 and 56 in all directions in the plane defined by the X-X direction and the Y-Y direction are substantially equal to each other. Thereby, the insertion member 22 can be displaced in all directions in the plane defined by the X-X direction and the Y-Y direction.

Moreover, the insertion member 41 provided in the connector according to the first embodiment (refer to FIG. 8) may be provided in the connector 50 according to the second variation instead of the insertion member 22.

Second Embodiment

Figure 10:
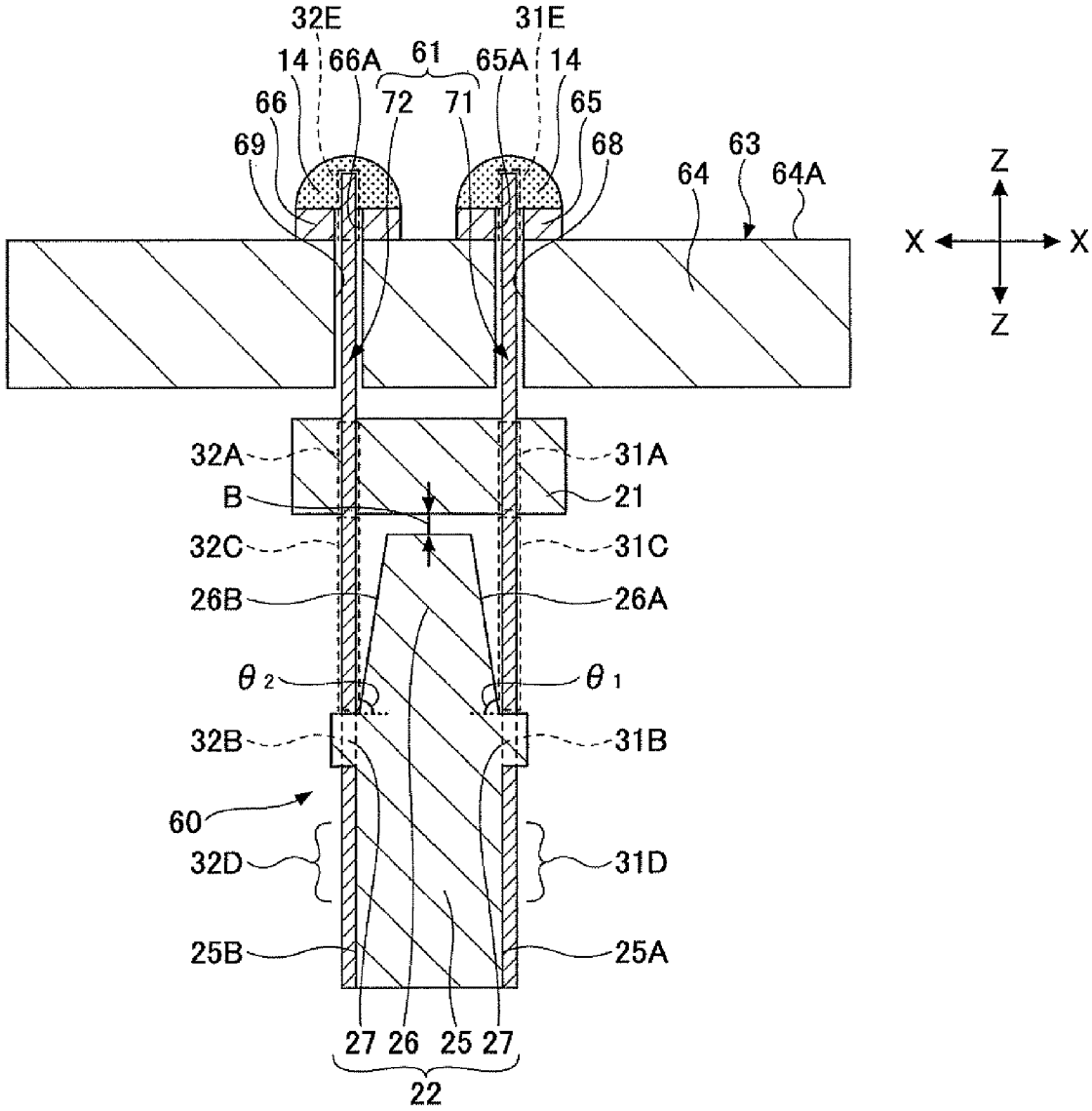
FIG. 10 is a cross-sectional view of a connector according to a second embodiment of the present invention.
Figure 11:
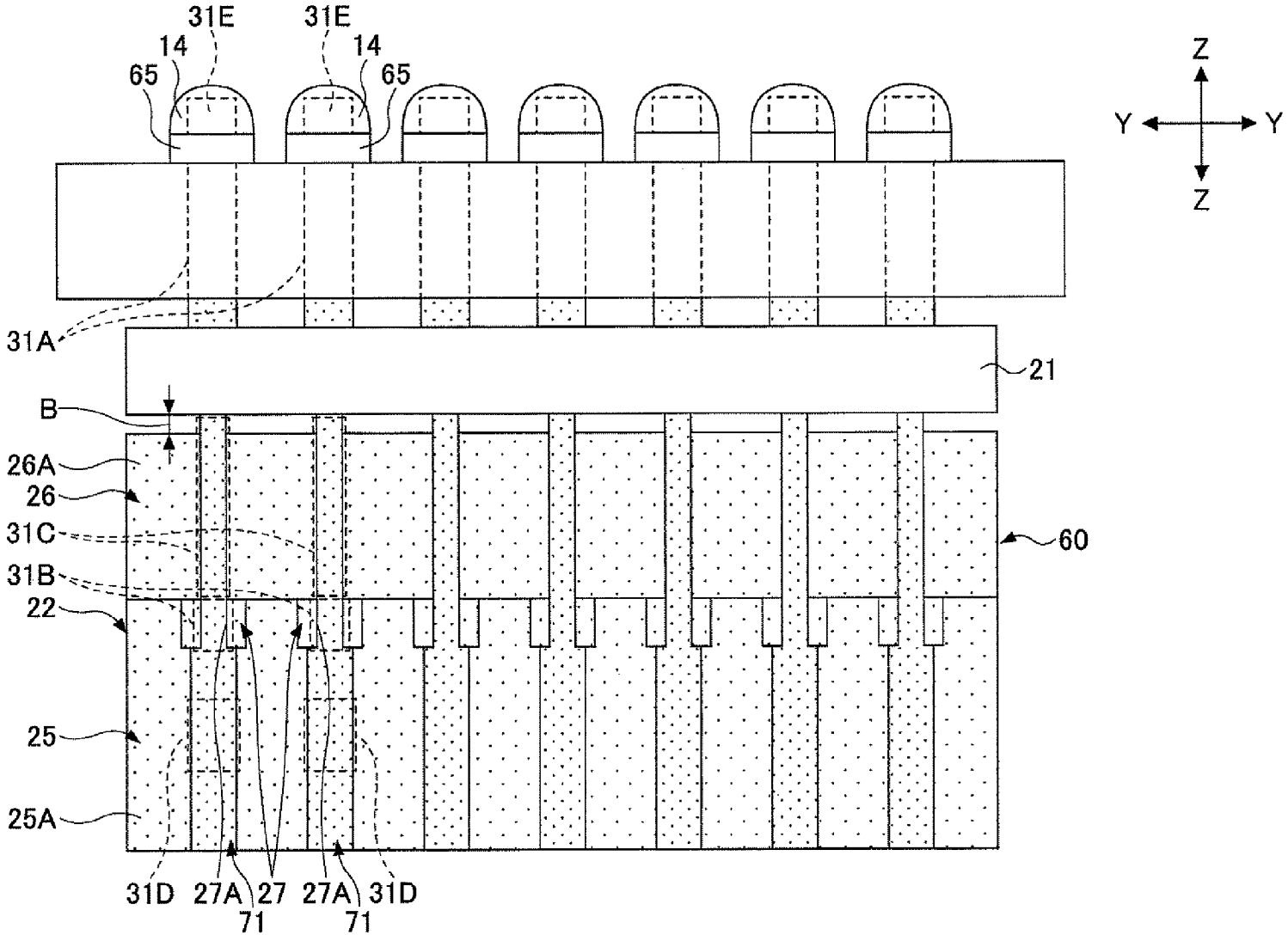
FIG. 11 is a side view of the connector illustrated in FIG. 10.

FIG. 10 is a cross-sectional view of a connector according to a second embodiment of the present invention. FIG. 11 is a side view of the connector illustrated in FIG. 10. In FIGS. 10 and 11, parts that are the same as the parts of the connector 10 according to the first embodiment are given the same reference numerals.

As illustrated in FIGS. 10 and 11, the connector 60 according to the second embodiment has the same structure as the connector 10 according to the first embodiment except that a contact pair 61 is provided instead of the contact pair 23 of the connector 10 and the contactor pair 61 is DIP mounted to a substrate 63.

Here, a description will be given of the substrate 63 to which the connector 60 is mounted. The substrate 63 includes a substrate main body 64 having an insulating layer (not shown in the figure), vias and wirings, and pads 65 and 66 formed on the substrate main body 64. The substrate main body 64 has a through hole 68, which is formed in a portion corresponding to the formation area of the pad 65, and a through hole 69, which is formed in a portion corresponding to the formation area of the pad 66.

The pad 65 is provided on an upper surface 64A of the substrate main body 64. The pad 65 has a through hole 65A in which the through hole 68 is exposed. The pad 65 is electrically connected to the vias and the wirings provided in the substrate main body 64. The pad 66 is provided on the upper surface 64A of the substrate main body 64. The pad 66 has a through hole 66A in which the through hole 69 is exposed.

The pad 66 is electrically connected to the vias and the wirings provided in the substrate main body 64. As for the substrate 63 having the above-mentioned structure, a probe card may be used.

The contact pair 61 includes a contact 71 and a contact 72. The contact 71 is provided on the side surface 25A of the insertion member main body 25. The contact 72 is provided on the side surface 25B of the insertion member main body 25. A plurality of contact pairs 61 are arranged on the side surfaces 25A and 25B of the insertion member main body 25. An arranging direction J of the contacts 71 and 72 of the contact pair 61 is coincident with the Y-Y direction. The contact pair 61 connects the fixed member 21 and the insertion member 22, which are arranged separately.

The contact 71 has the same structure as the contact 31 except the entire contact 71 is straight in the Z-Z direction without any bent portion. An end of the contact 71 on the side of the connection part 31E is inserted into the through holes 65A and 68 so that an end portion of the connection part 31E protrudes above the pad 65. The connection part 31E is fixed to the pad 65 by a solder 14 and electrically connected to the pad 65. That is, the contact 71 is DIP mounted to the substrate 63.

The contact 72 has the same structure as the contact 32 except r the entire contact 72 is straight in the Z-Z direction without any bent portion. An end of the contact 72 on the side of the connection part 32E is inserted into the through holes 66A and 69 so that an end portion of the connection part 32E protrudes above the pad 66. The connection part 32E is fixed to the pad 66 by a solder 14 and electrically connected to the pad 66. That is, the contact 72 is DIP mounted to the substrate 63.

As a material of the above-mentioned contacts 71 and 72, a material excellent in strength and electrical conductivity may be used. Specifically, the contacts 71 and 72 may be formed of a material such as a Cu—Ni—Si base (Corson series) alloy, a hyper phosphor bronze, a titanium copper, etc. The contacts 71 and 72 may be formed by punching a plate material.

By forming the contacts 71 and 72 by punching, a productivity can be improved as compared to a case where a contact is formed by bending work. Thus, according to the connector 60 of the present embodiment, the productivity of the contacts 71 and 72 can be improved, as compared to a case where a contact is formed by bending work, by forming the contacts 71 and 72, which are deformable in the X-X direction and the Y-Y direction, by punching a plate material.

Moreover, because the connector 60 according to the present embodiment has the contacts 71 and 72, of which deformable parts 31C and 32C are deformable in the X-X direction and the Y-Y direction (that is, the insertion member 22 is displaceable in the X-X direction and the Y-Y direction), the same effects as the connector 10 according to the first embodiment can be provided.

It should be noted that the insertion member 41 provided in the connector 40 according to the first variation of the first embodiment (refer to FIG. 8) may be provided to the connector 60 of the present embodiment instead of the insertion member 22.

Third Embodiment

Figure 12:
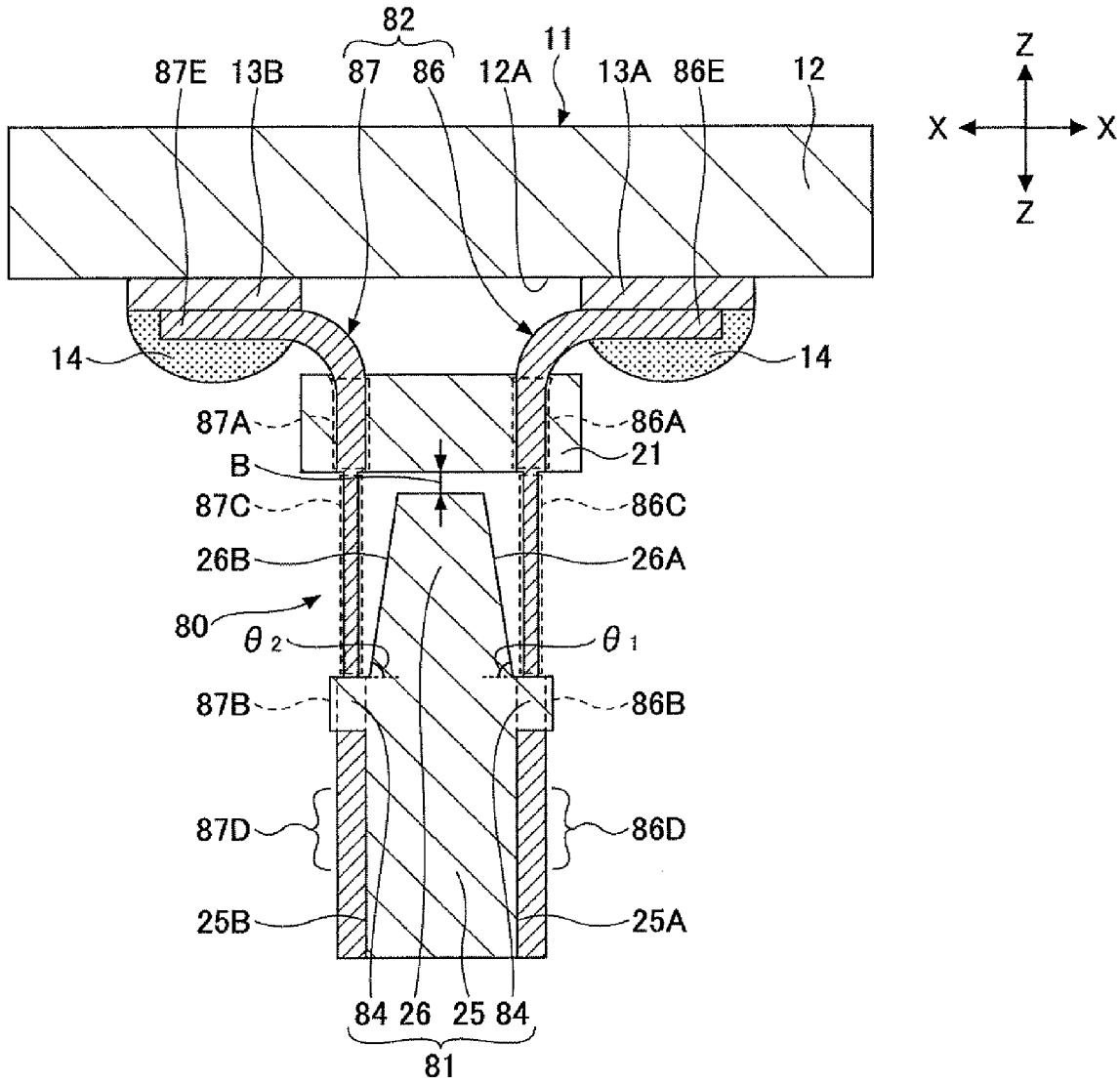
FIG. 12 is a cross-sectional view of a connector according to a third embodiment of the present invention.
Figure 13:
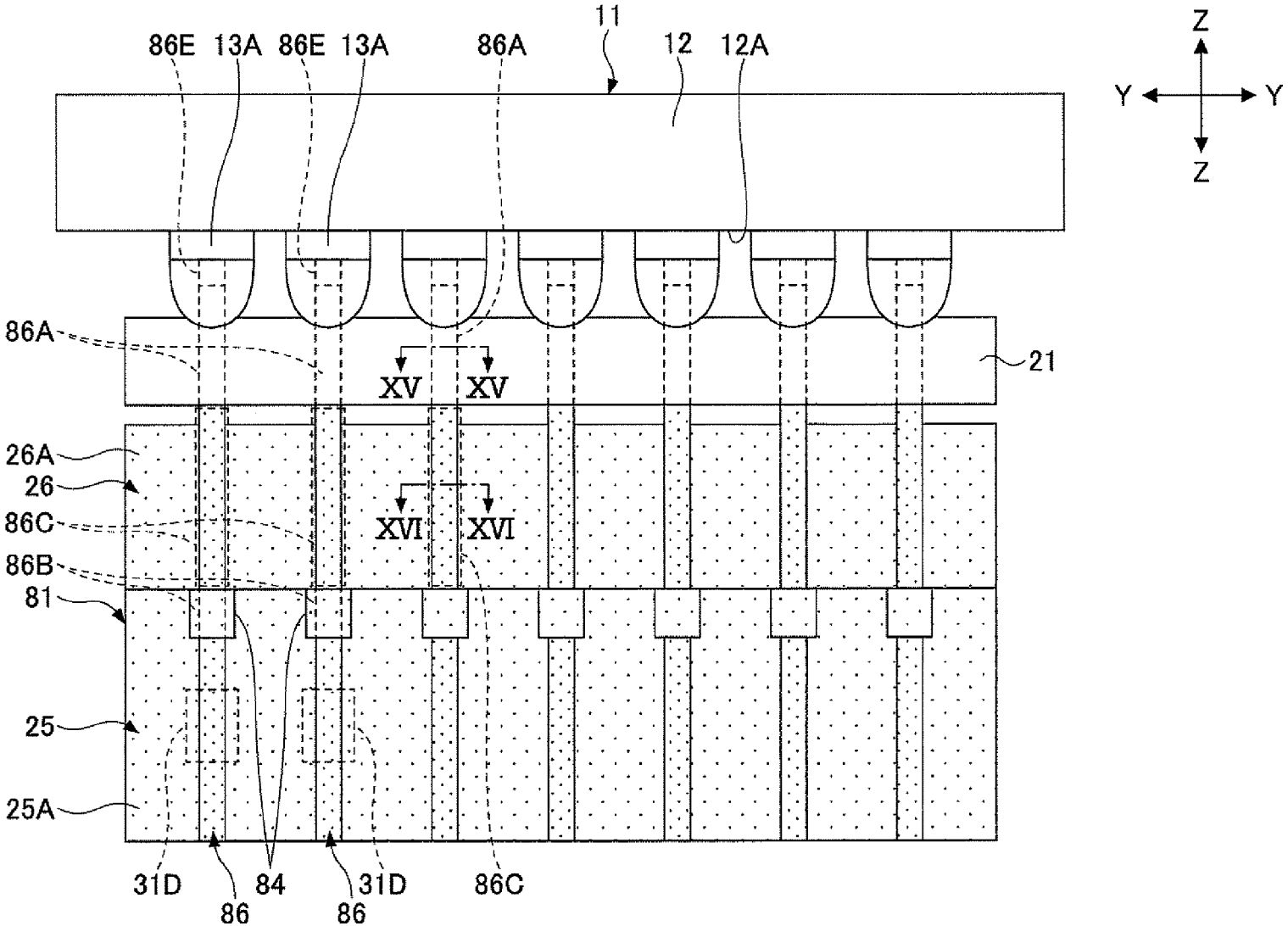
FIG. 13 is a side view of the connector illustrated in FIG. 12.

FIG. 12 is a cross-sectional view of a connector according to a third embodiment of the present invention. FIG. 13 is a side view of the connector illustrated in FIG. 12. In FIGS. 12 and 13, parts that are the same as the parts of the connector 10 according to the first embodiment are given the same reference numerals.

As illustrated in FIGS. 12 and 13, the connector 80 according to the third embodiment has the same structure as the connector 10 according to the first embodiment except for an insertion member 81 and a contact pair 82 being provided instead of the insertion member 22 and the contact pair 23 of the connector 10 of the first embodiment.

The insertion member 81 has the same structure as the insertion member 22 except that a contact attaching part 84 is provided to the insertion member 81 instead of the contact attaching part 27 provided in the contact member 22 so that one of contacts 86 and 87 of the contact pair 82 is attachable to the contact attaching part 84.

A plurality of contact attaching parts 84 are provided on the side surfaces 25A and 25B of the insertion member main body 25. The contact attaching part 84 is integrally formed with the insertion member main body 25, and has a penetrating slot (not illustrated in the figure) in which one of the contacts 86 and 87 of the contact pair 82 is attachable to the attaching part 84.

The contact pair 82 includes the contact 86, which is arranged on the side surface 25A of the insertion member main body 25, and the contact 87, which is arranged on the side surface 25B of the insertion member main body 25. The contact 87 is arranged opposite to the contact 86 via the insertion member main body 25. The contact pairs 82 are arranged on the side surfaces 25A and 25B of the insertion member main body 25 along an arranging direction J, which is coincident with the Y-Y direction.

Figure 14:
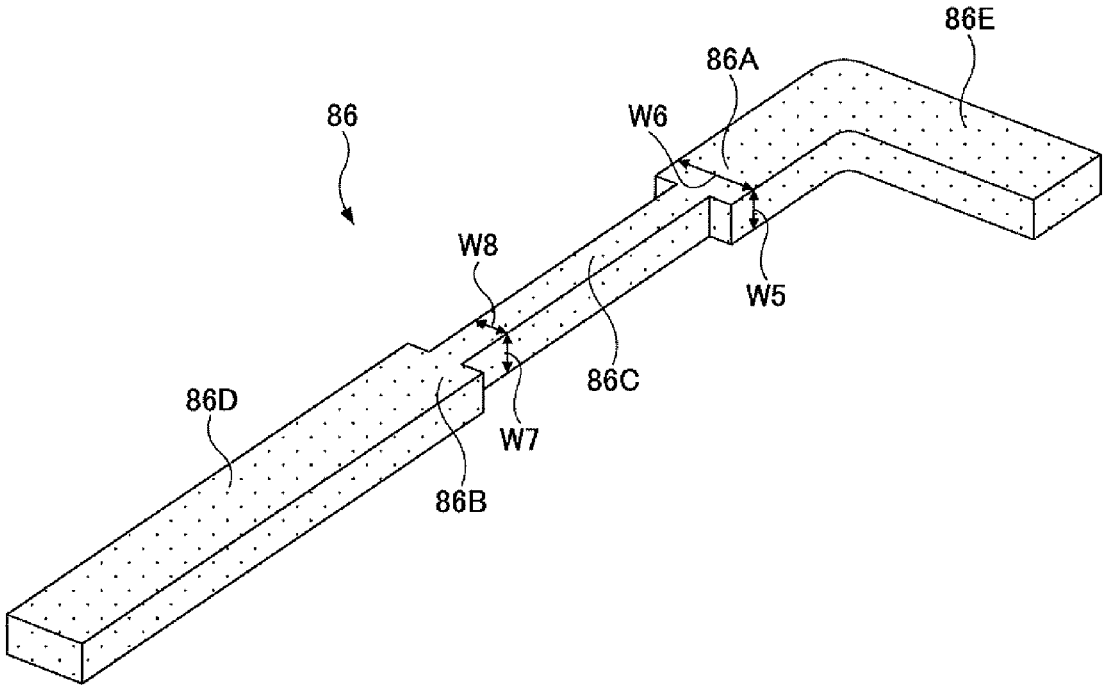
FIG. 14 is a perspective view of a contact illustrated in FIG. 12.

FIG. 14 is a perspective view of the contact illustrated in FIG. 12. Referring to FIG. 12 through FIG. 14, a plurality of contacts 86 are arranged on the side surface 25A of the insertion member main body 25. Each of the contacts 86 includes a first fixed part 86A, a second fixed part 86B, a deformable part 86C, a contact part 86D, and a connection part 86E, which are integrated with each other.

The first fixed part 86A is embedded in the fixed member 21 in a state where the first fixed part 86A penetrates the fixed member 21. Thereby, the contact 86 is fixed to the fixed member 21.

Figure 15:
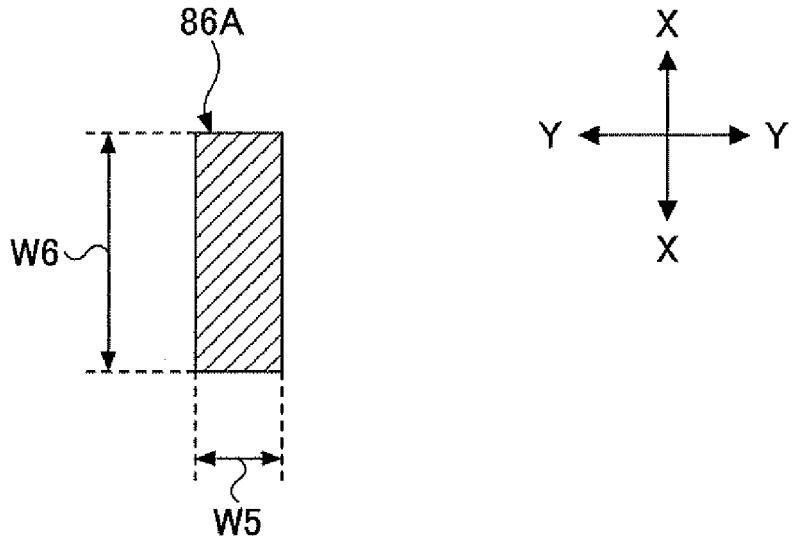
FIG. 15 is a cross-sectional view of a first fixed part illustrated in FIG. 13 taken along a line XV-XV.

FIG. 15 is a cross-sectional view of the first fixed part 86A illustrated in FIG. 13 taken along a line XV-XV. In FIG. 15, parts that are the same as the parts illustrated in FIG. 14 are given the same reference numerals.

As illustrated in FIG. 15, the cross-sectional shape of the first fixed part 86A is a rectangular shape having a width W5 in the Y-Y direction (the arranging direction of the contacts 86 and 87 of the contact pair 82) smaller than a width W6 in the X-X direction (a direction perpendicular to the arranging direction J). The width W5 of the first fixed part 8CA can be set to, for example, 0.15 mm. In such a case, the width W6 of the first fixed part 86A can be set to, for example, 0.3 mm.

Referring to FIG.12 through FIG. 14, the second fixed part 86B is attached in a penetrating slot (not illustrated in the figures) to the contact attaching part 84 formed on the side surface 25A of the insertion member main part 25. Thereby, the contact 86 is fixed to the insertion member 81.

The contact 86 fixes the first fixed part 86A to the fixed member 21, and also connects the fixed member 21 and the insertion member 81, which are arranged at separate positions, with each other by attaching the second fixed part 86B to the contact attaching part 84. The cross-sectional shape and dimensions (widths) of the second fixed part 86B can be substantially the same as the cross-sectional shape and dimensions (widths) of the first fixed part 86A.

The deformable part 86C is provided between the first fixed part 86A and the second fixed part 86B. The deformable part 86C extends in the Z-Z direction (refer to FIGS. 12 and 13) to connect the first fixed part 86A and the second fixed part 86B. The deformable part 86C is configured such that the insertion member 81 is displaceable relative to the fixed member 21 in the arranging direction J (Y-Y direction) of the contacts 86 and 87 of the contact pair 82 and the direction (X-X direction) perpendicular to the arranging direction J.

Figure 16:
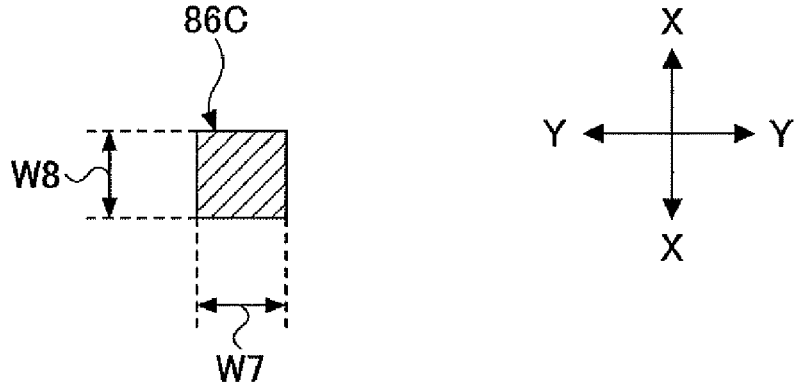
FIG. 16 is a cross-sectional view of a deformable part of a contact illustrated in FIG. 13 taken along a line XVI-XVI.

FIG. 16 is a cross-sectional view of the deformable part of the contact illustrated in FIG. 13 taken along a line XVI-XVI. In FIG. 16, parts that are the same as the parts of the contact 86 illustrated in FIG. 14 are given the same reference numerals.

As illustrated in FIG. 16, in the cross-sectional shape of the deformable part 86C, a width W7 of the deformable part 86C in the Y-Y direction is substantially equal to a width W8 of the deformable part 86C in the X-X direction. Specifically, the cross-sectional shape of the deformable part 86 can be, for example, a square shape. In such a case, the widths W7 and W8 of the deformable part 86C can be, for example, 0.15 mm.

As mentioned above, by setting the width W7 of the deformable part 86C in the arranging direction J (Y-Y direction) of the contacts 86 and 87 of the contact pair 82 to be substantially equal to the width W8 of the deformable part 86C in the direction (X-X direction) perpendicular to the arranging direction J, the rigidity of the deformable part 86C in the X-X direction can be substantially equal to the rigidity of the deformable part 86C in the Y-Y direction. Thereby, when an external force is exerted on the insertion member 81, the deformable part 86C can be deformed in the X-X direction and the Y-Y direction.

Referring to FIG. 12 through FIG. 14, the contact part 86D is arranged on the side surface 25A of the insertion member main body 25 in a state where the contact 86 is attached to the contact attaching part 84. The contact part 86D is a part to be brought into contact with the contact piece 17 provided in the insertion part 16 of the mating connector 15 (refer to FIG. 3). The cross-sectional shape and dimensions (widths) of the contact part 86D are substantially the same as the cross-sectional shape and dimensions (widths) of the first fixed part 86A mentioned before.

The connection part 86E is a part to electrically connect the contact 86 to the substrate 11. The connection part 86E is bent with respect to the first fixed part 86A so that the connection part 86E extends in the X-X direction in the state where the contact 86 is fixed to the substrate 11, the fixed member 21 and the insertion member 81 as illustrated in FIG. 12. The connection part 86E is fixed to the pad 13A provided in the bottom surface 12A of the substrate main part 12 with a solder 14. Thereby, the connection part 86E is fixed to the substrate 11 while being electrically connected to the substrate 11. The cross-sectional shape and dimensions (widths) of the connection part 86E can be substantially the same as the cross-sectional shape and dimensions (widths) of the first fixed part 86A mentioned before.

The above-mentioned contact 86 may be formed by punching a plate material. If the contact 86 is formed by punching a plate material, the productivity of the contact 86 can be improved, as compared to a case where a contact is formed by bending work.

As for the material of the contact 86, for example, a material excellent in strength and electrical conductivity can be used. Specifically, the contact 86 may be formed of a material such as, for example, a Cu—Ni—Si base (Corson series) alloy, a hyper phosphor bronze, a titanium copper, etc.

Additionally, a plurality of contacts 86 can be arranged at a narrow pitch because the widths of the first fixed part 86A, the second fixed part 86B, the deformable part 86C, the contact part 86D and the connection part 86E in the Y-Y direction (the arranging direction J) are substantially equal to each other, and the widths of the first fixed part 86A, the second fixed part 86B, the deformable part 86C, the contact part 86D and the connection part 86E in the Y-Y direction are smaller than the widths of the first fixed part 86A, the second fixed part 86B, the deformable part 86C, the contact part 86D and the connection part 86E in the X-X direction. Accordingly, the contact 86 having the above-mentioned structure is applicable to the pads 13A arranged on the substrate with a narrow pitch.

Referring to FIG. 12 through FIG. 14, a plurality of contacts 87 are arranged on the side surface 25B of the insertion member main body 25. Each of the contacts 87 includes a first fixed part 87A, a second fixed part 87B, a deformable part 87C, a contact part 87D, and a connection part 87E, which are integrated with each other.

The first fixed part 87A is embedded in the fixed member 21 in a state where the first fixed part 87A penetrates the fixed member 21. Thereby, the contact 87 is fixed to the fixed member 21. The cross-sectional shape of the first fixed part 87A is a rectangular shape having a width in the Y-Y direction smaller than a width in the X-X direction. The cross-sectional shape and dimensions (widths) of the first fixed part 87A can be substantially the same as the cross-sectional shape and dimensions (widths) of the first fixed part 86A mentioned before. Specifically, the width of the first fixed part 87A in the Y-Y direction can be set to, for example, 0.15 mm. In such a case, the width of the first fixed part 87A in the X-X direction can be set to, for example, 0.3 mm.

The second fixed part 87B is attached in a penetrating slot (not illustrated in the figures) to the contact attaching part 84 formed on the side surface 25B of the insertion member main part 25. Thereby, the contact 87 is fixed to the insertion member 81.

The contact 87 fixes the first fixed part 87A to the fixed member 21, and also connects the fixed member 21 and the insertion member 81, which are arranged at separate positions, with each other by attaching the second fixed part 87B to the contact attaching part 84. The cross-sectional shape and dimensions (widths) of the second fixed part 87B can be substantially the same as the cross-sectional shape and dimensions (widths) of the first fixed part 87A mentioned before.

The deformable part 87C is provided between the first fixed part 87A and the second fixed part 87B. The deformable part 87C extends in the Z-Z direction (refer to FIG. 12) to connect the first fixed part 87A and the second fixed part 87B. The deformable part 87C is configured such that the insertion member 81 is displaceable relative to the fixed member 21 in the arranging direction J (Y-Y direction) of the contacts 86 and 87 of the contact pair 82 and the direction (X-X direction) perpendicular to the arranging direction J.

Specifically, in the cross-sectional shape of the deformable part 87C, a width of the deformable part 87C in the Y-Y direction is substantially equal to a width of the deformable part 87C in the X-X direction. Specifically, the cross-sectional shape of the deformable part 87C can be, for example, a square shape. In such a case, the widths of the deformable part 87C in the X-X direction and the Y-Y direction can be, for example, 0.15 mm.

As mentioned above, by setting the width of the deformable part 87C in the arranging direction J (Y-Y direction) of the contacts 86 and 87 of the contact pair 82 to be substantially equal to the width of the deformable part 87C in the direction (X-X direction) perpendicularly to the arranging direction J, the rigidity of the deformable part 87C in the X-X direction can be substantially equal to the rigidity of the deformable part 87C in the Y-Y direction. Thereby, when an external force is exerted on the insertion member 81, the deformable part 87C can be caused to be deformed in the X-X direction and the Y-Y direction.

The contact part 87D is arranged on the side surface 25B of the insertion member main body 25 in a state where the contact 87 is attached to the contact attaching part 84. The contact part 87D is a part to be brought into contact with the contact piece 18 provided in the insertion part 16 of the mating connector 15 (refer to FIG. 3). The cross-sectional shape and dimensions (widths) of the contact part 87D are substantially the same as the cross-sectional shape and dimensions (widths) of the first fixed part 87A mentioned before.

The connection part 87E is a part to electrically connect the contact 87 to the substrate 11. The connection part 87E is bent with respect to the first fixed part 87A so that the connection part 87E extends in the X-X direction in the state where the contact 87 is fixed to the substrate 11, the fixed member 21 and the insertion member 81 as illustrated in FIG. 12. The connection part 87E is fixed to the pad 13B provided on the bottom surface 12A of the substrate main part 12 with a solder 14. Thereby, the connection part 87E is fixed to the substrate 11 while being electrically connected to the substrate 11. The cross-sectional shape and dimensions (widths) of the connection part 87E can be substantially the same as the cross-sectional shape and dimensions (widths) of the first fixed part 87A mentioned before.

The above-mentioned contact 87 may be formed by punching a plate material. If the contact 87 is formed by punching a plate material, the productivity of the contact 87 can be improved, as compared to a case where a contact is formed by bending work.

As for the material of the contact 87, for example, a material excellent in strength and electrical conductivity can be used. Specifically, the contact 87 may be formed of a material such as, for example, a Cu—Ni—Si base (Corson series) alloy, a hyper phosphor bronze, a titanium copper, etc.

Additionally, a plurality of contacts 87 can be arranged at a narrow pitch because the widths of the first fixed part 87A, the second fixed part 87B, the deformable part 87C, the contact part 87D and the connection part 87E in the Y-Y direction (the arranging direction J) are substantially equal to each other, and the widths of the first fixed part 87A, the second fixed part 87B, the deformable part 87C, the contact part 87D and the connection part 87E in the Y-Y direction are smaller than the widths of the first fixed part 87A, the second fixed part 87B, the deformable part 87C, the contact part 87D and the connection part 87E in the X-X direction. Accordingly, the contact 87 having the above-mentioned structure is applicable to the pads 13B arranged on the substrate with a narrow pitch.

As mentioned above, in the connector 80 according to the present embodiment, because the contacts 86 and 87 have the above-mentioned structures, the contacts 86 and 87 can be arranged at a narrow pitch. Thus, the connector 80 according to the present embodiment can be applied to the substrate 11 having the pads 13A and 13B arranged at a narrow pitch.

Moreover, as mentioned above, by forming the contacts 86 and 87 by punching a plate material, the productivity of the contacts 86 and 87 can be improved, as compared to a case where a contact is formed by bending work.

Further, the connector 80 according to the present embodiment can provide the same effect as the connector 10 according to the first embodiment. Specifically, even when the insertion member 22 of the connector 80 is displaced with respect to the insertion part 16 of the mating connector 15 in the X-X direction and/or the Y-Y direction, the insertion member 81 of the connector 80 can be surely inserted into the insertion part 16 of the mating connector 15 by moving the insertion member 81 in the X-X direction and/or Y-Y direction by causing the deformable parts 86C and 87C to deform in the X-X direction and/or the Y-Y direction.

Although the cross-sectional shape of each of the deformable parts 86C and 87C is a square shape in the present embodiment, the cross-sectional shape of each of the deformable parts 86C and 87C is not limited to a square shape if it is a shape in which the widths of the deformable parts 86C and 87C in the arranging direction J (Y-Y direction) of the contacts 86 and 87 of the contact pair 82 are substantially equal to the widths of the deformable parts 86C and 87C in the direction (X-X direction) perpendicular to the arranging direction J. For example, the cross-sectional shape of each of the deformable parts 86C and 87C may be a circular shape.

If the cross-sectional shape of each of the deformable parts 86C and 87C is a circular shape, the rigidities of the deformable parts 86C and 87C in all directions in the plane defined by the X-X direction and the Y-Y direction are substantially equal to each other. Thereby, the insertion member 81 can be displaced in all directions in the plane defined by the X-X direction and the Y-Y direction. The deformable parts 86C and 87C may be formed in a circular cross-sectional shape by grinding or cutting the deformable parts 86C and 87C having a square cross-sectional shape as illustrated in FIG. 14 after forming the contacts 86 and 87 by punching a plate material as illustrated in FIG. 14.

Moreover, the shape of the projection part 26 provided in the connector 80 may be changed to the shape of the projection part 42 as illustrated in FIG. 8.

Figure 17:
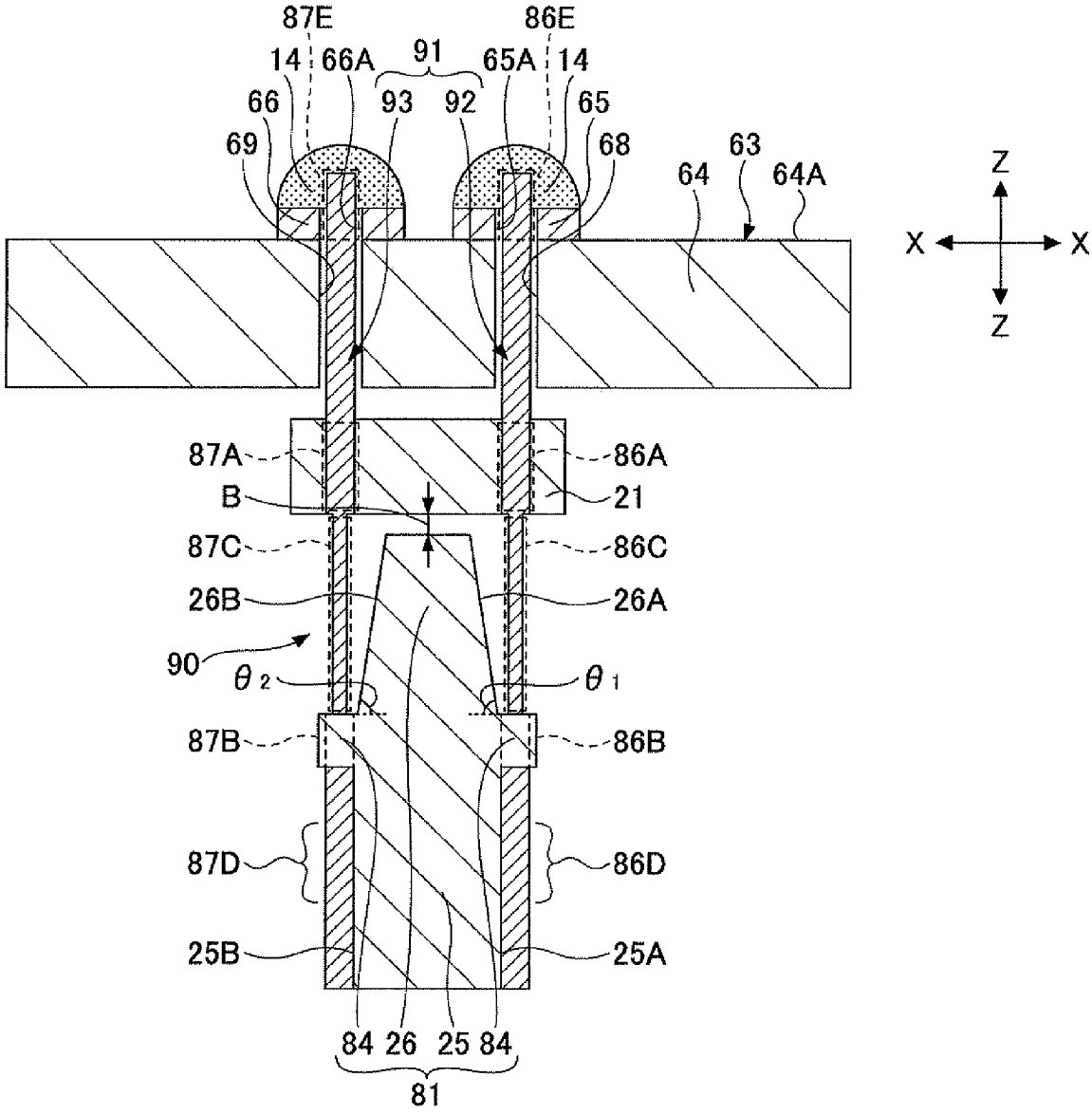
FIG. 17 is a cross-sectional view of a connector according to a variation of the third embodiment of the present invention.

FIG. 17 is a cross-sectional view of a connector according to a variation of the third embodiment of the present invention. In FIG. 17, parts that are the same as the parts illustrated in FIGS. 10 and 12 are given the same reference numerals.

As illustrated in FIG. 17, the connector 90 according to a variation of the third embodiment has the same structure as the connector 80 except that a contact pair 91 is provided instead of the contact pair 82 of the connector 80 and the contact pair 91 is DIP mounted to the substrate illustrated in FIG. 10.

The contact pair 91 includes a contact 92, which is provided on the side surface 25A of the insertion member main part 25, and a contact 93, which is provided on the side surface 25B of the insertion member main part 25. A plurality of contact pairs 91 are arranged on the side surfaces 25A and 25B of the insertion member main part 25. The contact pair 91 connects the fixed member 21 and the insertion member 81, which are arranged at separate positions.

The contacts 92 has the same structure as the L-shaped contact 86 (refer to FIG. 14) described in the third embodiment except for the entire contact 92 extending in the Z-Z direction without any bent portion. An end of the contact 92 on the side of the connection part 86E is inserted into the through holes 65A and 68 so that an end portion of the connection part 86E protrudes above the pad 65. The connection part 86E is fixed to the pad 65 by a solder 14 and electrically connected to the pad 65.

The contact 93 has the same structure as the L-shaped contact 87 described in the third embodiment except for the entire contact 93 extending in the Z-Z direction without any bent portion. An end of the contact 92 on the side of the connection part 87E is inserted into the through holes 66A and 69 so that an end portion of the connection part 87E protrudes above the pad 66. The connection part 87E is fixed to the pad 66 by a solder 14 and electrically connected to the pad 66.

As for the material of the contacts 92 and 93, for example, a material excellent in strength and electrical conductivity can be used. Specifically, the contacts 92 and 93 may be formed of a material such as, for example, a Cu—Ni—Si base (Corson series) alloy, a hyper phosphor bronze, a titanium copper, etc. Additionally, for example, the contacts 92 and 93 can be formed by punching a plate material. If the contacts 92 and 93 are formed by punching a plate material, the productivity of the contacts 92 and 93 can be improved, as compared to a case where a contact is formed by bending work.

The connector 90 according to the variation of the third embodiment can provide the same effects as the connector 80 according to the third embodiment.

It should be noted that although the connectors 10, 40, 50, 60, 80 and 90 are configured as male connectors in the first through third embodiments, the connectors 10, 40, 50, 60, 80 and 90 may be configured as female connectors.

All examples and conditional language recited herein are intended for pedagogical purposes to aid the reader in understanding the principles of the invention and the concepts contributed by the inventor to furthering the art, and are to be construed a being without limitation to such specifically recited examples and conditions, nor does the organization of such examples in the specification relates to a showing of the superiority and inferiority of the invention. Although the embodiment(s) of the present invention (s) has(have) been described in detail, it should be understood that the various changes, substitutions, and alterations could be made hereto without departing from the spirit and scope of the invention.

What is claimed is:

1. A connector comprising:

a fixed member configured to be fixed to a substrate;

an insertion member arranged separately from said fixed member and configured to be insertable into an insertion part of a mating connector; and a plurality of pairs of contacts arranged on side surfaces of said insertion part of said mating connector, the pairs of contacts connecting said fixed member and said insertion member to each other, wherein each contact of each pair of contacts includes a first fixed part fixed to said fixed member, a second fixed part fixed to said insertion member, and a contact part arranged on a side surface of said insertion member and configured to be brought into contact with a contact piece provided in said insertion part of said mating connector, and wherein a cross-sectional shape of a portion of each contact between said first fixed part and said second fixed part is configured in a shape such that said insertion member is displaceable relative to said fixed member in an arranging direction of the pair of contacts and a direction perpendicular to the arranging direction.

2. The connector according to claim 1, wherein said portion of each contact between said first fixed part and said second fixed part has a width in the arranging direction substantially equal to a width in the direction perpendicular to the arranging direction.

3. The connector according to claim 1, wherein said cross-sectional shape of said portion of said each contact between said first fixed part and said second fixed part is a square shape.

4. The connector according to claim 1, wherein said cross-sectional shape of said portion of said each contact between said first fixed part and said second fixed part is a circular shape.

5. The connector according to claim 1, wherein a portion of said insertion member arranged between said fixed member and said second fixed part has a width in the direction perpendicular to the arranging direction, the width being gradually reduced from said second fixed part toward said fixed member.

6. The connector according to claim 1, wherein each contact is formed by punching a plate material.

7. The connector according to claim 1, wherein said portion of said each contact between said first fixed part and said second fixed part is straight.

8. The connector according to claim 1, wherein said portion of said each contact between said first fixed part and said second fixed part is bent.

9. The connector according to claim 8, wherein said portion of said each contact between said first fixed part and said second fixed part is folded twice.

10. The connector according to claim 1, wherein a portion of said insertion member facing said portion of said each contact between said first fixed part and said second fixed part is slanted with respect to an extending direction of said portion of said each contact between said first fixed part and said second fixed part.

11. The connector according to claim 1, wherein a top of a portion of said insertion member facing said portion of said each contact between said first fixed part and said second fixed part is separated from said fixed member by a predetermined distance.

* * * * *